US009653206B2

(12) United States Patent
Keeling et al.

(10) Patent No.: US 9,653,206 B2
(45) **Date of Patent: *May 16, 2017**

(54) WIRELESS POWER CHARGING PAD AND METHOD OF CONSTRUCTION

(71) Applicant: QUALCOMM Incorporated, San Diego, CA (US)

(72) Inventors: Nicholas A Keeling, Auckland (NZ); Edward Van Boheemen, Auckland (NZ); Michael Kissin, Auckland (NZ); Jonathan Beaver, Auckland (NZ)

(73) Assignee: QUALCOMM Incorporated, San Diego, CA (US)

( * ) Notice: Subject to any disclaimer, the term of this patent is extended or adjusted under 35 U.S.C. 154(b) by 948 days.

This patent is subject to a terminal disclaimer.

(21) Appl. No.: 13/669,304

(22) Filed: Nov. 5, 2012

(65) Prior Publication Data

US 2013/0300202 A1 Nov. 14, 2013

Related U.S. Application Data

(60) Provisional application No. 61/613,378, filed on Mar. 20, 2012, provisional application No. 61/613,390, filed on Mar. 20, 2012.

(51) Int. Cl.

| | |
|---|---|
| ***H01F 38/14*** | (2006.01) |
| ***H01F 27/02*** | (2006.01) |
| ***H01F 41/00*** | (2006.01) |

(52) U.S. Cl.

CPC ..... *H01F 38/14* (2013.01); *H01F 27/022* (2013.01); *H01F 41/00* (2013.01); *H01F 41/005* (2013.01); *Y10T 29/49117* (2015.01)

(58) Field of Classification Search

None

See application file for complete search history.

(56) References Cited

U.S. PATENT DOCUMENTS 3,902,147 A * 8/1975 Trench ..... H01F 37/005 336/180

4,234,865 A 11/1980 Shigehara (Continued)

FOREIGN PATENT DOCUMENTS

CN 1411009 A 4/2003

CN 1950914 A 4/2007

(Continued)

OTHER PUBLICATIONS

"Heat-shrink tubing", as published Mar. 10, 2012, Wikipedia, retrieved via archive.org/web at <http://web.archive.org/web/20120310052307/http://en.wikipedia.org/wiki/Heat-shrink_tubing>.*

(Continued)

*Primary Examiner* — Fritz M Fleming

*Assistant Examiner* — David Shiao

(74) *Attorney, Agent, or Firm* — Knobbe Martens Olson & Bear LLP

(57) ABSTRACT

Systems, methods and apparatus for a wireless power transfer are disclosed. In one aspect a wireless power transfer apparatus is provided. The apparatus includes a casing. The apparatus further includes an electrical component housed within the casing. The apparatus further includes a sheath housed within the casing. The apparatus further includes a conductive filament housed within the sheath. The electrical component is electrically connected with the conductive filament. The casing is filled with a settable fluid bound with the sheath to form a structural matrix.

30 Claims, 13 Drawing Sheets

(56) References Cited

U.S. PATENT DOCUMENTS

| | | | | |
|---|---|---|---|---|
| 4,538,863 | A * | 9/1985 | Allen | H01F 38/14 439/39 |
| 4,605,818 | A * | 8/1986 | Arroyo | G02B 6/4436 156/54 |
| 4,623,865 | A | 11/1986 | Kiesel et al. | |
| 4,800,328 | A * | 1/1989 | Bolger | B60L 5/005 191/10 |
| 6,198,373 | B1 * | 3/2001 | Ogawa | H01F 17/0033 336/83 |
| 6,239,682 | B1 | 5/2001 | McCloskey | |
| 6,333,573 | B1 | 12/2001 | Nakamura | |
| 6,768,409 | B2 * | 7/2004 | Inoue | H01F 17/0013 29/602.1 |
| 6,784,778 | B2 | 8/2004 | Stitz et al. | |
| 6,794,975 | B2 * | 9/2004 | Iwao | H01F 38/14 336/90 |
| 7,154,204 | B2 | 12/2006 | Koenig | |
| 7,280,022 | B2 | 10/2007 | Shinmen et al. | |
| 7,595,571 | B2 | 9/2009 | Thirunarayan-Kumar et al. | |
| 7,986,059 | B2 | 7/2011 | Randall | |
| 8,035,255 | B2 | 10/2011 | Kurs et al. | |
| 8,042,742 | B2 * | 10/2011 | Kagaya | G06K 19/07718 235/492 |
| 8,174,234 | B2 | 5/2012 | Julstrom et al. | |
| 8,525,868 | B2 | 9/2013 | Forutanpour et al. | |
| 8,928,445 | B2 * | 1/2015 | Mori | B21D 26/14 335/216 |
| 2004/0124958 | A1 * | 7/2004 | Watts | H01F 38/023 336/178 |
| 2006/0104006 | A1 | 5/2006 | Toshiharu | |
| 2006/0133622 | A1 | 6/2006 | Chen | |
| 2007/0222426 | A1 | 9/2007 | Waffenschmidt et al. | |
| 2007/0287508 | A1 | 12/2007 | Telefus | |
| 2008/0129246 | A1 | 6/2008 | Morita et al. | |
| 2009/0096413 | A1 | 4/2009 | Partovi et al. | |
| 2009/0160262 | A1 * | 6/2009 | Schmidt | H01F 27/2847 307/104 |
| 2009/0273242 | A1 | 11/2009 | Cook | |
| 2009/0289752 | A1 | 11/2009 | Katsunori | |
| 2010/0264872 | A1 | 10/2010 | Kwong | |
| 2010/0277121 | A1 | 11/2010 | Hall et al. | |
| 2010/0314946 | A1 | 12/2010 | Budde et al. | |
| 2011/0062806 | A1 | 3/2011 | Ohashi et al. | |
| 2011/0140539 | A1 * | 6/2011 | Yamamoto | H01B 7/30 307/104 |
| 2011/0162881 | A1 | 7/2011 | Schipporeit | |
| 2011/0187317 | A1 | 8/2011 | Mitake et al. | |
| 2011/0234028 | A1 | 9/2011 | Iwasaki et al. | |
| 2011/0316475 | A1 | 12/2011 | Jung et al. | |
| 2012/0020485 | A1 | 1/2012 | Visser et al. | |
| 2012/0026837 | A1 | 2/2012 | Li et al. | |
| 2012/0074899 | A1 | 3/2012 | Tsai et al. | |
| 2012/0091950 | A1 | 4/2012 | Campanella et al. | |
| 2012/0119698 | A1 | 5/2012 | Karalis et al. | |
| 2012/0161696 | A1 | 6/2012 | Cook et al. | |
| 2012/0224456 | A1 | 9/2012 | Visser et al. | |
| 2013/0249303 | A1 | 9/2013 | Keeling et al. | |
| 2013/0249304 | A1 | 9/2013 | Keeling et al. | |
| 2013/0249477 | A1 | 9/2013 | Keeling et al. | |
| 2016/0027577 | A1 | 1/2016 | Keeling et al. | |

FOREIGN PATENT DOCUMENTS

| | | | |
|---|---|---|---|
| CN | 101454957 | A | 6/2009 |
| CN | 101490923 | A | 7/2009 |
| CN | 102089952 | A | 6/2011 |
| DE | 19839458 | | 3/2000 |
| DE | 102006025458 | A1 | 12/2007 |
| DE | 102010050935 | A1 | 9/2011 |
| EP | 1298683 | A2 | 4/2003 |
| JP | S5339461 | A | 4/1978 |
| JP | S59117106 | A | 7/1984 |
| JP | H01175224 | A | 7/1989 |
| JP | H0696965 | A | 4/1994 |
| JP | H07192934 | A | 7/1995 |
| JP | H07254517 | A | 10/1995 |
| JP | H08255717 | A | 10/1996 |
| JP | H10632 | A | 1/1998 |
| JP | 2000150273 | A | 5/2000 |
| JP | 2001008380 | A | 1/2001 |
| JP | 2001210512 | A | 8/2001 |
| JP | 2008087733 | A | 4/2008 |
| JP | 2008120239 | A | 5/2008 |
| JP | 2010003838 | A | 1/2010 |
| JP | 2010172084 | A | 8/2010 |
| JP | 2010263075 | A | 11/2010 |
| JP | 2011204836 | A | 10/2011 |
| WO | 2009123432 | A2 | 10/2009 |
| WO | WO-2009151818 | | 12/2009 |
| WO | 2010090538 | A1 | 8/2010 |
| WO | 2010090539 | A1 | 8/2010 |
| WO | WO-2012157114 | A1 | 11/2012 |

OTHER PUBLICATIONS

International Search Report and Written Opinion—PCT/US2013/029317—ISA/EPO—Jun. 4, 2013.

* cited by examiner

WIRELESS POWER CHARGING PAD AND METHOD OF CONSTRUCTION

CROSS REFERENCE TO RELATED APPLICATIONS

This application claims priority to and the benefit under 35 U.S.C. §119(e) to U.S. Provisional Patent Application No. 61/613,378 entitled "WIRELESS POWER CHARGING PAD AND METHOD OF CONSTRUCTION" filed on Mar. 20, 2012, the disclosure of which is hereby incorporated by reference in its entirety. This application further claims priority to and the benefit under 35 U.S.C. §119(e) to U.S. Provisional Patent Application No. 61/613,390 entitled "WIRELESS POWER CHARGING PAD AND METHOD OF CONSTRUCTION" filed on Mar. 20, 2012, the disclosure of which is also hereby incorporated by reference in its entirety.

FIELD

The disclosure relates generally to wireless power transfer, and more specifically to devices, systems, and methods related to wireless power transfer to remote systems such as battery-powered vehicles. In particular, the disclosure relates to methods of constructing devices for use in wireless power transfer, such as pads which are subject to physical and environmental conditions.

BACKGROUND

Remote systems, such as vehicles, have been introduced that include locomotion power derived from electricity received from an energy storage device such as a battery. For example, hybrid electric vehicles include on-board chargers that use power from vehicle braking and motors to charge the vehicles. Vehicles that are solely electric generally receive the electricity for charging the batteries from other sources. Battery electric vehicles (electric vehicles) are often proposed to be charged through some type of wired alternating current (AC) such as household or commercial AC supply sources. The wired charging connections require cables or other similar connectors that are physically connected to a power supply. Cables and similar connectors may sometimes be inconvenient or cumbersome and have other drawbacks. Wireless charging systems that are capable of transferring power in free space (e.g., via a wireless field) to be used to charge electric vehicles may overcome some of the deficiencies of wired charging solutions. As such, wireless charging systems and methods that efficiently and safely transfer power for charging electric vehicles are the subject of the present disclosure.

SUMMARY

Various implementations of systems, methods and devices within the scope of the appended claims each have several aspects intended to address at least one of the foregoing objectives, with no single aspect being solely responsible for the desirable attributes described herein. Without limiting the scope of the appended claims, some prominent features are described herein.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

One aspect of the disclosure provides a wireless power transfer apparatus. The apparatus includes a casing. The apparatus further includes an electrical component housed within the casing. The apparatus further includes a sheath housed within the casing. The apparatus further includes a conductive filament housed within the sheath. The electrical component is electrically connected with the conductive filament. The casing is filled with a settable fluid which is bound to the sheath and forms a structural matrix.

Another aspect of the disclosure provides an implementation of a method of constructing an impact resistive device. The method includes assembling electronic components with conductive material to form conductive filaments in a casing. At least a part of the conductive filaments are within a sheath. The method further includes introducing a settable fluid into the casing. The method further includes forming a structural matrix within the casing from the fluid substance and the conductive filaments. The settable fluid binds with the sheath.

Yet another aspect of the disclosure provides a wireless power transfer apparatus. The wireless power transfer apparatus includes means for encasing electrical components. The wireless power transfer apparatus further includes means for conducting electricity. The wireless power transfer apparatus further includes means for wrapping the means for conducting. The means for encasing is filled with a settable fluid bound to the means for wrapping to form a structural matrix.

Figure 1:
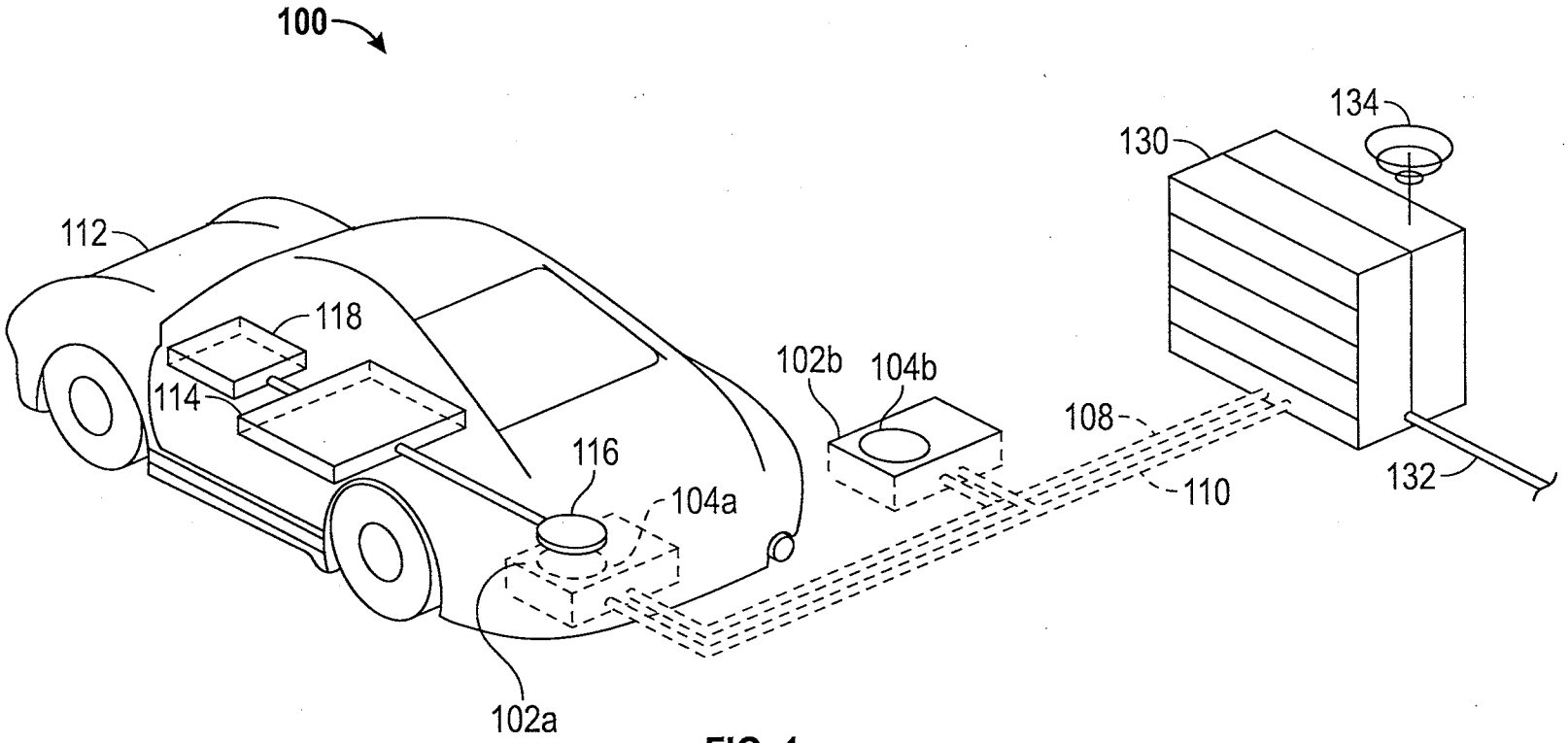
FIG. 1 is a perspective view of an exemplary wireless power transfer system for charging an electric vehicle, in accordance with an exemplary embodiment.

The various features illustrated in the drawings may not be drawn to scale. Accordingly, the dimensions of the various features may be arbitrarily expanded or reduced for clarity. In addition, some of the drawings may not depict all of the components of a given system, method or device.

DETAILED DESCRIPTION

In the following detailed description, reference is made to the accompanying drawings, which form a part of the present disclosure. In the drawings, similar symbols typically identify similar components, unless context dictates otherwise. The illustrative embodiments described in the detailed description, drawings, and claims are not meant to be limiting. The detailed description set forth below in connection with the appended drawings is intended as a description of exemplary embodiments and is not intended to represent the only embodiments which may be practiced. The term "exemplary" used throughout this description means "serving as an example, instance, or illustration," and should not necessarily be construed as preferred or advantageous over other exemplary embodiments. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure.

The terminology used herein is for the purpose of describing particular embodiments only and is not intended to be limiting of the disclosure. It will be understood by those within the art that if a specific number of a claim element is intended, such intent will be explicitly recited in the claim, and in the absence of such recitation, no such intent is present. For example, as used herein, the singular forms "a", "an" and "the" are intended to include the plural forms as well, unless the context clearly indicates otherwise. As used herein, the term "and/or" includes any and all combinations of one or more of the associated listed items. It will be further understood that the terms "comprises," "comprising," "includes," and "including," when used in this specification, specify the presence of stated features, integers, steps, operations, elements, and/or components, but do not preclude the presence or addition of one or more other features, integers, steps, operations, elements, components, and/or groups thereof. Expressions such as "at least one of," when preceding a list of elements, modify the entire list of elements and do not modify the individual elements of the list.

Wirelessly transferring power may refer to transferring any form of energy associated with electric fields, magnetic fields, electromagnetic fields, or otherwise from a transmitter to a receiver without the use of physical electrical conductors (e.g., power may be transferred through free space). The power output into a wireless field (e.g., a magnetic field) may be received by, captured by, or coupled by a "receiving coil" to achieve power transfer. Accordingly, the terms "wireless" and "wirelessly" are used to indicate that power transfer between charging station and remote system is achieved without use of a cord-type electric conductor therebetween.

An electric vehicle is used herein to describe a remote system, an example of which is a vehicle that includes, as part of its locomotion capabilities, electrical power derived from a chargeable energy storage device (e.g., one or more rechargeable electrochemical cells or other type of battery). As non-limiting examples, some electric vehicles may be hybrid electric vehicles that include besides electric motors, a combustion engine for direct locomotion or to charge the vehicle's battery. Other electric vehicles may draw all locomotion ability from electrical power. An electric vehicle is not limited to an automobile and may include motorcycles, carts, scooters, and the like. By way of example and not limitation, a remote system is described herein in the form of an electric vehicle (EV). Furthermore, other remote systems that may be at least partially powered using a chargeable energy storage device are also contemplated (e.g., electronic devices such as personal computing devices, mobile phones, and the like).

FIG. 1 is a perspective view of an exemplary wireless power transfer system 100 for charging an electric vehicle 112, in accordance with an exemplary embodiment. The wireless power transfer system 100 enables charging of an electric vehicle 112 while the electric vehicle 112 is parked near a base wireless charging system 102*a*. Spaces for two electric vehicles are illustrated in a parking area. Each charging space is configured such that an electric vehicle can drive into the charging space and park over a corresponding base wireless charging system, such as base wireless charging systems 102*a* and 102*b*. In some embodiments, a local distribution center 130 may be connected to a power backbone 132 and configured to provide an alternating current (AC) or a direct current (DC) supply through a power link 110 to the base wireless charging system 102*b*. The power link may be an electric cable, cord, wire, or other device for transporting power along a distance. In some embodiments, power backbone 132 supplies power via power link 110 to one base wireless charging system; in other embodiments, the power backbone 132 may supply power via power link 110 to two or more base wireless charging systems. Thus, in some embodiments, power link 110 extends beyond base wireless charging system 102*b*, delivering power to additional base wireless charging systems, such as base wireless charging system 102*a*. While the description hereinafter refers to base wireless charging system 102*a* and its various components, the description is also applicable to base wireless charging system 102*b* and to any additional base wireless charging systems included within a wireless power transfer system 100.

Local distribution 130 may be configured to communicate with external sources (e.g., a power grid) via a communication backhaul 134, and with all base wireless charging systems, such as, for example, base wireless charging systems 102*a* via a communication link 108. Communication link 108 may include one or more cables or other devices for transporting signals along a distance.

The base wireless charging system 102*a* of various embodiments includes a base system induction coil 104*a* for wirelessly transferring or receiving power. When an electric vehicle 112 is within range of the base system charging system 102*a*, power may be transferred between the base wireless induction coil 104*a* and an electric vehicle induction coil 116 within the electric vehicle 112. In some embodiments, power may be transmitted from the base wireless induction coil 104*a* to the electric vehicle induction coil 116. Power received by the electric vehicle induction coil 116 can then be transported to one or more components within the electric vehicle 112 to provide power to the electric vehicle 112. Such components within the electric vehicle 112 include, for example, a battery unit 118 and an electric vehicle wireless charging system 114. The electric vehicle induction coil 116 may interact with the base system induction coil 104*a* for example, via a region of the electromagnetic field generated by the base system induction coil 104*a*.

In some exemplary embodiments, the electric vehicle induction coil 116 is said to be within range of, and may receive power from, the base system induction coil 104*a* when the electric vehicle induction coil 116 is located within a target region of the electromagnetic field generated by the base system induction coil 104*a*. The target region corresponds to at least part of a region where energy output by the base system induction coil 104*a* may be captured by an electric vehicle induction coil 116. In some cases, the field may correspond to the "near-field" of the base system induction coil 104*a*. The near-field is at least a part of the electromagnetic field produced by the base system induction coil 104*a*. The near-field may correspond to a region in which there are strong reactive fields that results from the currents and charges in the base system induction coil 104*a* and that do not radiate power away from the base system induction coil 104*a*. In some cases, the near-field may correspond to a region that is within approximately ½ π of the wavelength of the base system induction coil 104*a*. Additionally, in various embodiments, described in more detail below, power may be transmitted from the electric vehicle induction coil 116 to the base system induction coil 104*a*. In such embodiments, the near-field may correspond to a region that is within approximately ½ π of the wavelength of the electric vehicle induction coil 116.

In various embodiments, aligning the electric vehicle induction coil 116 such that it is disposed within the near-field region of the base system induction coil 104*a* may advantageously improve or maximize power transfer efficiency. In some embodiments, the electric vehicle induction coil 116 may be aligned with the base system induction coil 104*a*, and therefore, disposed within the near-field region simply by the driver properly aligning the electric vehicle 112 relative to the base system induction coil 104*a*. In other embodiments, the driver may be given visual feedback, auditory feedback, or combinations thereof to determine when the electric vehicle 112 is properly placed for wireless power transfer. In yet other embodiments, the electric vehicle 112 may be positioned by an autopilot system, which may move the electric vehicle 112 back and forth (e.g., in zig-zag movements) until an alignment error has reached a tolerable value. This may be performed automatically and autonomously by the electric vehicle 112 without or with only minimal driver intervention provided that the electric vehicle 112 is equipped with a servo steering wheel, ultrasonic sensors, and intelligence to adjust the vehicle. In still other embodiments, the electric vehicle induction coil 116, the base system induction coil 104*a*, or a combination thereof may have functionality for displacing and moving the induction coils 116 and 104*a* relative to each other to more accurately orient them and develop more efficient coupling therebetween.

The base wireless charging system 102*a* may be located in a variety of locations. As non-limiting examples, some suitable locations include a parking area at a home of the electric vehicle 112 owner, parking areas reserved for electric vehicle wireless charging modeled after conventional petroleum-based filling stations, and parking lots at other locations such as shopping centers and places of employment.

Charging electric vehicles wirelessly may provide numerous benefits. For example, charging may be performed automatically, virtually without driver intervention and manipulations thereby improving convenience to a user. There may also be no exposed electrical contacts and no mechanical wear out, thereby improving reliability of the wireless power transfer system 100. Manipulations with cables and connectors can be avoided, and there may be no cables, plugs, or sockets that may be exposed to moisture and water in an outdoor environment, thereby improving safety. There may also be no sockets, cables, and plugs visible or accessible, thereby reducing potential vandalism of power charging devices. Further, since an electric vehicle 112 may be used as distributed storage devices to stabilize a power grid, a docking-to-grid solution may be used to increase availability of vehicles for Vehicle-to-Grid (V2G) operation.

A wireless power transfer system 100 as described with reference to FIG. 1 may also provide aesthetical and non-impedimental advantages. For example, there may be no charge columns and cables that may be impedimental for vehicles and/or pedestrians.

As a further explanation of the vehicle-to-grid capability, the wireless power transmit and receive capabilities may be configured to be reciprocal such that the base wireless charging system 102*a* transfers power to the electric vehicle 112 and the electric vehicle 112 transfers power to the base wireless charging system 102*a* e.g., in times of energy shortfall. This capability may be useful to stabilize the power distribution grid by allowing electric vehicles to contribute power to the overall distribution system in times of energy shortfall caused by over demand or shortfall in renewable energy production (e.g., wind or solar).

Figure 2:
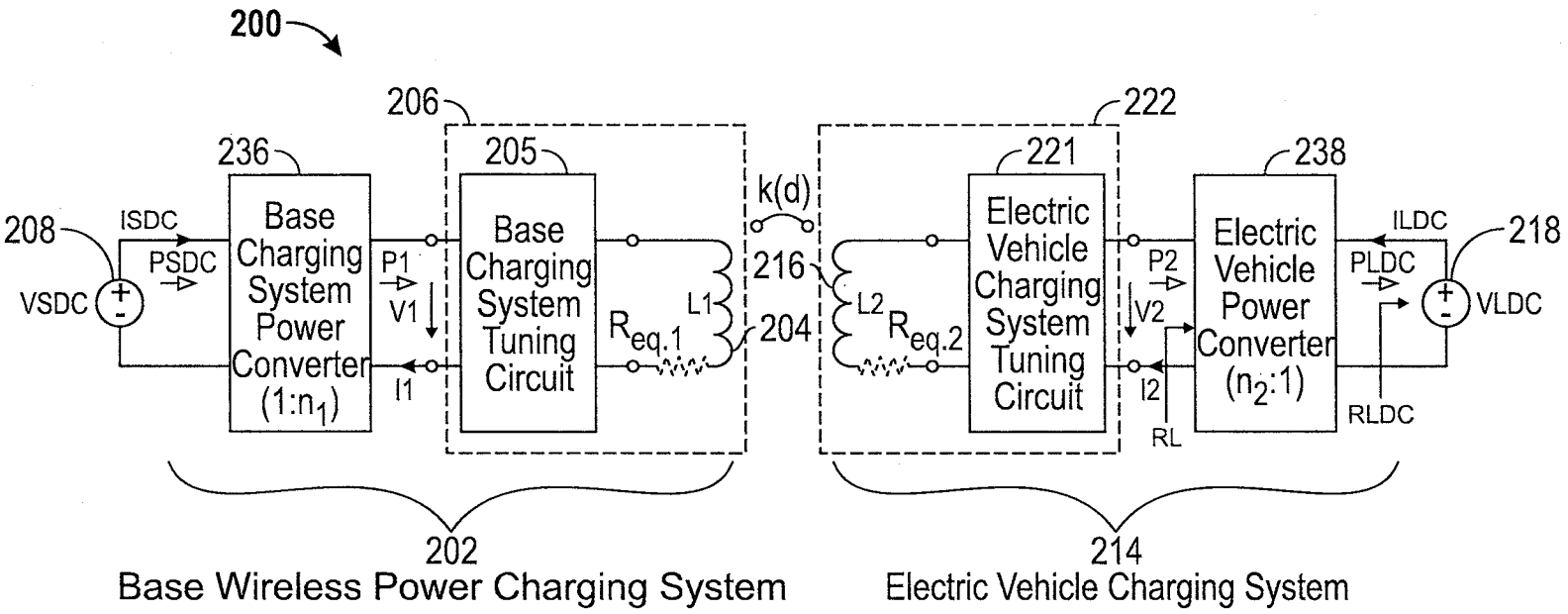
FIG. 2 is a schematic diagram of exemplary core components of the wireless power transfer system of FIG. 1.

FIG. 2 is a schematic diagram of exemplary components of the wireless power transfer system 100 of FIG. 1. As shown in FIG. 2, the wireless power transfer system 200 may include a base wireless power charging system 202, which includes base system transmit circuit 206 having a base system induction coil 204 with an inductance $L_1$. The wireless power transfer system 200 further includes an electric vehicle charging system 214, which includes electric vehicle receive circuit 222 having an electric vehicle induction coil 216 with an inductance $L_2$.

Certain embodiments described herein may use capacitively loaded wire loops (i.e., multi-turn coils) to form a resonant structure that is capable of efficiently coupling energy from a primary structure (transmitter) to a secondary structure (receiver) via a magnetic or electromagnetic near-field if both primary and secondary are tuned to a common resonant frequency. In some embodiments, the electric vehicle induction coil 216 and the base system induction coil 204 may each comprise multi-turn coils. Using resonant structures for coupling energy may be referred to as "magnetic coupled resonance," "electromagnetic coupled resonance," and/or "resonant induction." The operation of the wireless power transfer system 200 will be described based on power transfer from a base wireless power charging system 202 to an electric vehicle 112, but is not limited thereto. For example, as discussed above, the electric vehicle 112 may transfer power to the base wireless charging system 102*a*.

With reference to FIG. 2, a power supply 208 (e.g., AC or DC) supplies power $P_{SDC}$ to the base wireless power charging system 202 to transfer energy to an electric vehicle 112.

The base wireless power charging system 202 includes a base charging system power converter 236. The base charging system power converter 236 may include circuitry such as an AC/DC converter configured to convert power from standard mains AC to DC power at a suitable voltage level, and a DC/low frequency (LF) converter configured to convert DC power to power at an operating frequency suitable for wireless high power transfer. The base charging system power converter 236 supplies power $P_1$ to the base system transmit circuit 206, including to a base charging system tuning circuit 205 which may include reactive tuning components in a series or parallel configuration or a combination of both and the base system induction coil 204, to emit an electromagnetic field at a desired frequency. In one embodiment, a capacitor may be provided to form a resonant circuit with the base system induction coil 204 that resonates at a desired frequency. The base system induction coil 204 receives the power $P_1$ and wirelessly transmits power at a level sufficient to charge or power the electric vehicle 112. For example, the power level provided wirelessly by the base system induction coil 204 may be on the order of kilowatts (kW) (e.g., anywhere from 1 kW to 110 kW or higher or lower).

The base system transmit circuit 206 including base system induction coil 204, and the electric vehicle receive circuit 222, including electric vehicle induction coil 216 may be tuned to substantially the same frequencies and may be positioned within the near-field of an electromagnetic field transmitted by one of the base system induction coil 204 and the electric vehicle induction coil 216.

In this case, the base system induction coil 204 and electric vehicle induction coil 216 may become coupled to one another through the electromagnetic field therebetween such that power may be transferred to the electric vehicle receive circuit 222 including to an electric vehicle charging system tuning circuit 221 and electric vehicle induction coil 216. The electric vehicle charging system tuning circuit 221 may be provided to form a resonant circuit with the electric vehicle induction coil 216 so that the electric vehicle induction coil 216 resonates at a desired frequency. The mutual coupling coefficient resulting at coil separation is represented by k(d). Equivalent resistances $R_{eq.1}$ and $R_{eq.2}$ represent the losses that may be inherent to the induction coils 204 and 216 and any anti-reactance capacitors $C_1$ and $C_2$ that may, in some embodiments, be provided in the base charging system tuning circuit 205 and electric vehicle charging system tuning circuit 221 respectively. The electric vehicle receive circuit 222, including the electric vehicle induction coil 216 and electric vehicle charging system tuning circuit 221, receives power $P_2$ from the base wireless power charging system 202 via the electromagnetic field between induction coils 204 and 216. The electric vehicle receive circuit 222 then provides the power $P_2$ to an electric vehicle power converter 238 of an electric vehicle charging system 214 to enable usage of the power by the electric vehicle 112.

The electric vehicle power converter 238 may include, among other things, an LF/DC converter configured to convert power at an operating frequency back to DC power at a voltage level matched to the voltage level of an electric vehicle battery unit 218. The electric vehicle power converter 238 may provide the converted power $P_{LDC}$ to charge the electric vehicle battery unit 218. The power supply 208, base charging system power converter 236, and base system induction coil 204 may be stationary and located at a variety of locations as discussed above. The battery unit 218, electric vehicle power converter 238, and electric vehicle induction coil 216 may be included in an electric vehicle charging system 214 that is part of electric vehicle 112 or part of a battery pack (not shown). The electric vehicle charging system 214 may also be configured to provide power wirelessly through the electric vehicle induction coil 216 to the base wireless power charging system 202 to feed power back to the grid. Each of the electric vehicle induction coil 216 and the base system induction coil 204 may act as transmit or receive induction coils based on the mode of operation.

While not shown, the wireless power transfer system 200 may include a load disconnect unit (LDU) to safely disconnect the electric vehicle battery unit 218 or the power supply 208 from the wireless power transfer system 200. For example, in case of an emergency or system failure, the LDU may be triggered to disconnect the load from the wireless power transfer system 200. The LDU may be provided in addition to a battery management system for managing charging to a battery, or it may be part of the battery management system.

Further, the electric vehicle charging system 214 may include switching circuitry (not shown) for selectively connecting and disconnecting the electric vehicle induction coil 216 to the electric vehicle power converter 238. Disconnecting the electric vehicle induction coil 216 may suspend charging and also may adjust the "load" as "seen" by the base wireless charging system 202 (acting as a transmitter), which may be used to "decouple" the electric vehicle charging system 214 (acting as the receiver) from the base wireless charging system 202. The load changes may be detected if the transmitter includes the load sensing circuit. Accordingly, the transmitter, such as a base wireless charging system 202, may have a mechanism for determining when receivers, such as an electric vehicle charging system 214, are present in the near-field of the base system induction coil 204.

As described above, in operation, assuming energy transfer towards the vehicle or battery, input power is provided from the power supply 208 such that the base system induction coil 204 generates a field for providing the energy transfer. The electric vehicle induction coil 216 couples to the radiated field and generates output power for storage or consumption by the electric vehicle 112. As described above, in some embodiments, the base system induction coil 204 and electric vehicle induction coil 206 are configured according to a mutual resonant relationship such that the resonant frequency of the electric vehicle induction coil 216 and the resonant frequency of the base system induction coil 204 are very close or substantially the same. Transmission losses between the base wireless power charging system 202 and electric vehicle charging system 214 are minimal when the electric vehicle induction coil 216 is located in the near-field of the base system induction coil 204.

As stated, an efficient energy transfer occurs by coupling a large portion of the energy in the near-field of a transmitting induction coil to a receiving induction coil rather than propagating most of the energy in an electromagnetic wave beyond the far-field. When in the near-field, a coupling mode may be established between the transmit induction coil and the receive induction coil. The area around the induction coils where this near-field coupling may occur is referred to herein as a near-field coupling mode region.

While not shown, the base charging system power converter 236 and the electric vehicle power converter 238 may both include an oscillator, a driver circuit such as a power amplifier, a filter, and a matching circuit for efficient coupling with the wireless power induction coil. The oscillator may be configured to generate a desired frequency, which may be adjusted in response to an adjustment signal. The oscillator signal may be amplified by a power amplifier with an amplification amount responsive to control signals. The filter and matching circuit may be included to filter out harmonics or other unwanted frequencies and match the impedance of the power conversion module to the wireless power induction coil. The power converters 236 and 238 may also include a rectifier and switching circuitry to generate a suitable power output to charge a battery or power a load.

The electric vehicle induction coil 216 and base system induction coil 204 as described throughout the disclosed embodiments may be referred to or configured as "loop" antennas, and more specifically, multi-turn loop antennas. The induction coils 204 and 216 may also be referred to herein or be configured as "magnetic" antennas. The term "coils" is intended to refer to a component that may wirelessly output or receive energy for coupling to another "coil." The coil may also be referred to as an "antenna" of a type that is configured to wirelessly output or receive power. As used herein, coils 204 and 216 are examples of "power transfer components" of a type that are configured to wirelessly output, wirelessly receive, and/or wirelessly relay power. Loop (e.g., multi-turn loop) antennas may be configured to include an air core or a physical core such as a ferrite core. An air core loop antenna may allow the placement of other components within the core area. Physical core antennas including ferromagnetic or ferromagnetic materials may allow development of a stronger electromagnetic field and improved coupling.

A resonant frequency may be based on the inductance and capacitance of a transmit circuit including an induction coil (e.g., the base system induction coil 204) as described above. As shown in FIG. 2, inductance may generally be the inductance of the induction coil, whereas, capacitance may be added to the induction coil to create a resonant structure at a desired resonant frequency. As a non limiting example, a capacitor (not shown) may be added in series with the induction coil (e.g., induction coil 204) to create a resonant circuit (e.g., the base system transmit circuit 206) that generates an electromagnetic field. Accordingly, for larger diameter induction coils, the value of capacitance for inducing resonance may decrease as the diameter or inductance of the coil increases. Inductance may also depend on a number of turns of an induction coil. Furthermore, as the diameter of the induction coil increases, the efficient energy transfer area of the near-field may increase. Other resonant circuits are possible. As another non limiting example, a capacitor may be placed in parallel between the two terminals of the induction coil (e.g., a parallel resonant circuit). Furthermore an induction coil may be designed to have a high quality (Q) factor to improve the resonance of the induction coil.

Figure 3:
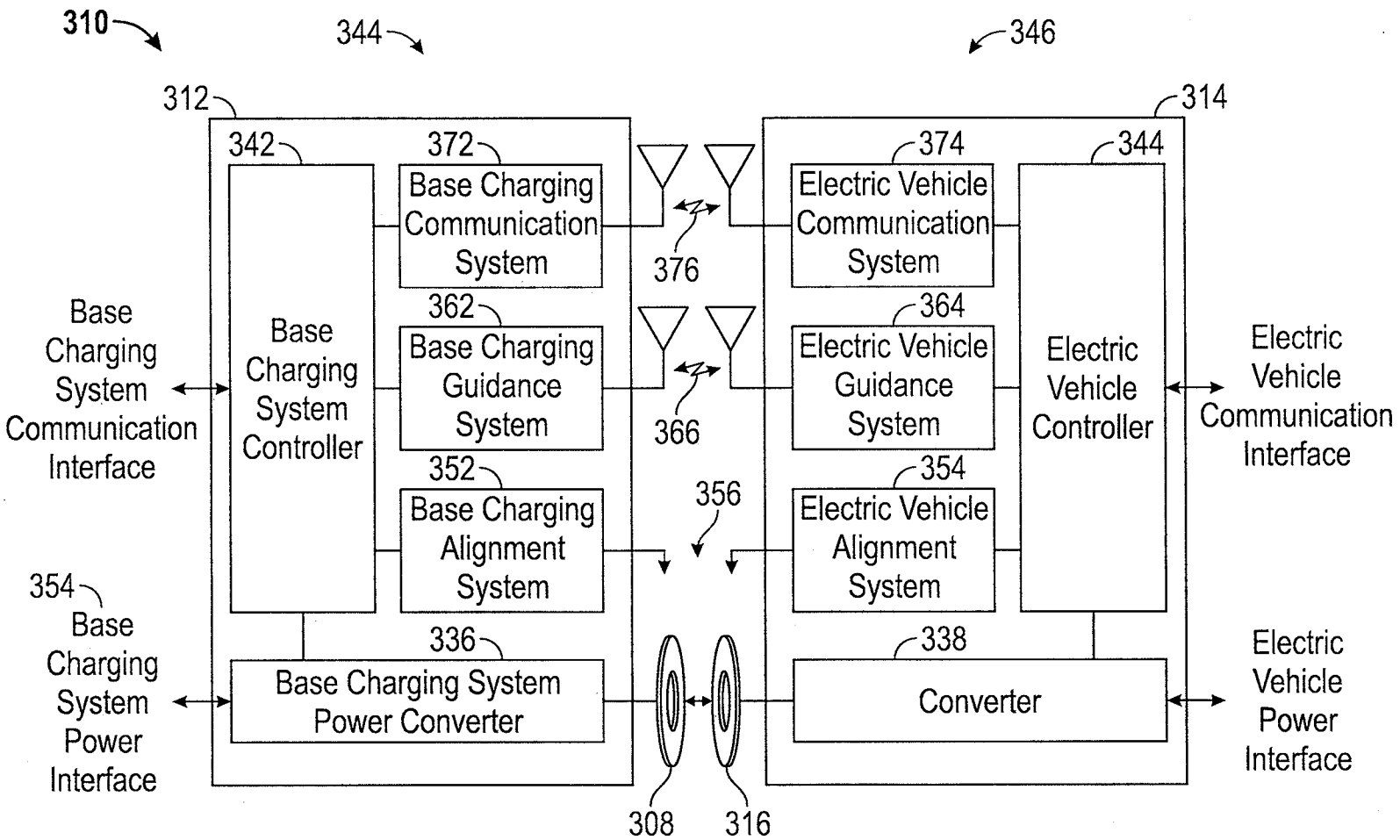
FIG. 3 is a functional block diagram showing exemplary core and ancillary components of the wireless power transfer system of FIG. 1, in accordance with an exemplary embodiment.

FIG. 3 is a functional block diagram showing exemplary core and ancillary components of the wireless power transfer system 300 of FIG. 1. The wireless power transfer system 300 illustrates a communication link 376, a guidance link 366, and alignment systems 352, 354 for the base system induction coil 304 and electric vehicle induction coil 316. As described above with reference to FIG. 2, showing an example energy flow towards the electric vehicle 112, FIG. 3 depicts a base charging system power interface 354 that may be configured to provide power to a charging system power converter 336 from a power source, such as an AC or DC power supply 126. The base charging system power converter 336 may receive AC or DC power from the base charging system power interface 354 to excite the base system induction coil 304 at or near its resonant frequency. The electric vehicle induction coil 316, when in the near-field coupling-mode region, may receive energy from the near-field coupling mode region to oscillate at or near the resonant frequency. The electric vehicle power converter 338 converts the oscillating signal from the electric vehicle induction coil 316 to a power signal suitable for charging a battery via the electric vehicle power interface.

The base wireless charging system 302 includes a base charging system controller 342 and the electric vehicle charging system 314 includes an electric vehicle controller 344. The base charging system controller 342 may include a base charging system communication interface 162 to other systems (not shown) such as, for example, a computer, and a power distribution center, or a smart power grid. The electric vehicle controller 344 may include an electric vehicle communication interface to other systems (not shown) such as, for example, an on-board computer on the vehicle, other battery charging controller, other electronic systems within the vehicles, and remote electronic systems.

The base charging system controller 342 and electric vehicle controller 344 may include subsystems or modules for specific application with separate communication channels. These communications channels may be separate physical channels or separate logical channels. As non-limiting examples, a base charging alignment system 352 may communicate with an electric vehicle alignment system 354 through a communication link 376 to provide a feedback mechanism for more closely aligning the base system induction coil 304 and electric vehicle induction coil 316, either autonomously or with operator assistance. Similarly, a base charging guidance system 362 may communicate with an electric vehicle guidance system 364 through a guidance link to provide a feedback mechanism to guide an operator in aligning the base system induction coil 304 and electric vehicle induction coil 316. In addition, there may be separate general-purpose communication links (e.g., channels) supported by base charging communication system 372 and electric vehicle communication system 374 for communicating other information between the base wireless power charging system 302 and the electric vehicle charging system 314. This information may include information about electric vehicle characteristics, battery characteristics, charging status, and power capabilities of both the base wireless power charging system 302 and the electric vehicle charging system 314, as well as maintenance and diagnostic data for the electric vehicle 112. These communication channels may be separate physical communication channels such as, for example, Bluetooth, zigbee, cellular, etc.

Electric vehicle controller 344 may also include a battery management system (BMS) (not shown) that manages charge and discharge of the electric vehicle principal battery, a parking assistance system based on microwave or ultrasonic radar principles, a brake system configured to perform a semi-automatic parking operation, and a steering wheel servo system configured to assist with a largely automated parking 'park by wire' that may provide higher parking accuracy, thus reducing the need for mechanical horizontal induction coil alignment in any of the base wireless charging system 102*a* and the electric vehicle charging system 114. Further, electric vehicle controller 344 may be configured to communicate with electronics of the electric vehicle 112. For example, electric vehicle controller 344 may be configured to communicate with visual output devices (e.g., a dashboard display), acoustic/audio output devices (e.g., buzzer, speakers), mechanical input devices (e.g., keyboard, touch screen, and pointing devices such as joystick, trackball, etc.), and audio input devices (e.g., microphone with electronic voice recognition).

Furthermore, the wireless power transfer system 300 may include detection and sensor systems. For example, the wireless power transfer system 300 may include sensors for use with systems to properly guide the driver or the vehicle to the charging spot, sensors to mutually align the induction coils with the required separation/coupling, sensors to detect objects that may obstruct the electric vehicle induction coil 316 from moving to a particular height and/or position to achieve coupling, and safety sensors for use with systems to perform a reliable, damage free, and safe operation of the system. For example, a safety sensor may include a sensor for detection of presence of animals or children approaching the wireless power induction coils 104*a*, 116 beyond a safety radius, detection of metal objects near the base system induction coil 304 that may be heated up (induction heating), detection of hazardous events such as incandescent objects on the base system induction coil 304, and temperature monitoring of the base wireless power charging system 302 and electric vehicle charging system 314 components.

The wireless power transfer system 300 may also support plug-in charging via a wired connection. A wired charge port may integrate the outputs of the two different chargers prior to transferring power to or from the electric vehicle 112. Switching circuits may provide the functionality to support both wireless charging and charging via a wired charge port.

To communicate between a base wireless charging system 302 and an electric vehicle charging system 314, the wireless power transfer system 300 may employ both in-band signaling or an RF data modem (e.g., Ethernet over radio in an unlicensed band) or both. The out-of-band communication may provide sufficient bandwidth for the allocation of value-add services to the vehicle user/owner. A low depth amplitude or phase modulation of the wireless power carrier may serve as an in-band signaling system with minimal interference.

In some embodiments, communication may be performed via the wireless power link without using specific communications antennas. For example, the wireless power induction coils 304 and 316 may also be configured to act as wireless communication transmitters and/or receivers. Thus, some embodiments of the base wireless power charging system 302 may include a controller (not shown) for enabling keying type protocol on the wireless power path. By way of illustration, keying the transmit power level (amplitude shift keying) at predefined intervals with a predefined protocol may provide a mechanism why which the receiver may detect a serial communication from the transmitter. The base charging system power converter 336 may include a load sensing circuit (not shown) for detecting the presence or absence of active electric vehicle receivers in the vicinity of the near-field generated by the base system induction coil 304. By way of example, a load sensing circuit monitors the current flowing to the power amplifier, which is affected by the presence or absence of active receivers in the vicinity of the near-field generated by base system induction coil 104*a*. Detection of changes to the loading on the power amplifier may be monitored by the base charging system controller 342 for use in determining whether to enable the oscillator for transmitting energy, to communicate with an active receiver, or a combination thereof.

To enable wireless high power transfer, some embodiments may be configured to transfer power at a frequency in the range from 10-60 kHz. This low frequency coupling may allow highly efficient power conversion that may be achieved using solid state devices. In addition, there may be less coexistence issues with radio systems compared to other bands.

Figure 4:
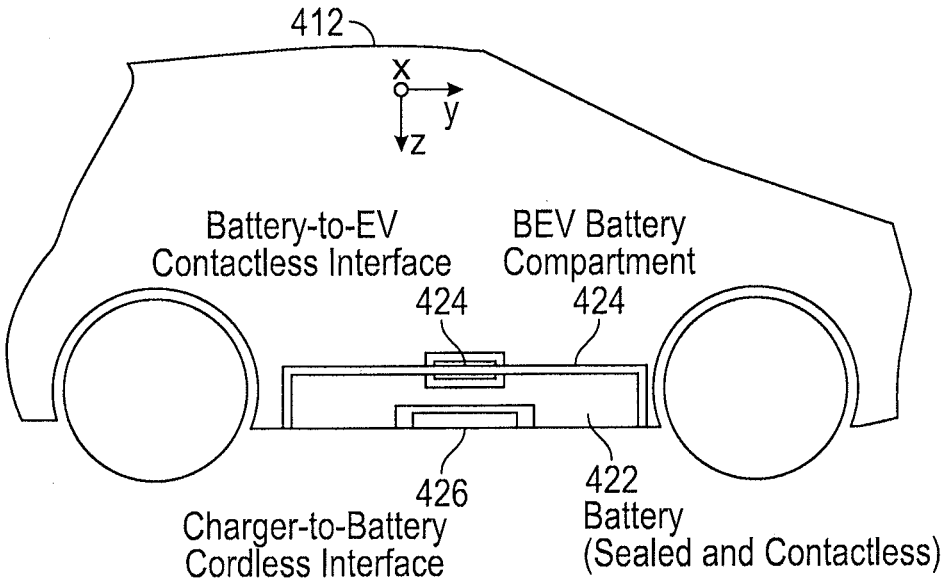
FIG. 4 is a functional diagram showing a replaceable contactless battery disposed in an electric vehicle, in accordance with an exemplary embodiment.

The wireless power transfer system 100 described may be used with a variety of electric vehicles 102 including rechargeable or replaceable batteries. FIG. 4 is a functional diagram showing a replaceable contactless battery 422 disposed in an electric vehicle 412, in accordance with an exemplary embodiment. In this embodiment, the low battery position may be useful for an electric vehicle battery unit that integrates a wireless power interface (e.g., a charger-to-battery cordless interface 426) and that may receive power from a charger (not shown) embedded in the ground. In FIG. 4, the electric vehicle battery unit may be a rechargeable battery unit, and may be accommodated in a battery compartment 424. The electric vehicle battery unit also provides a wireless power interface 426, which may integrate the entire electric vehicle wireless power subsystem including a resonant induction coil, power conversion circuitry, and other control and communications functions for efficient and safe wireless energy transfer between a ground-based wireless charging unit and the electric vehicle battery unit.

It may be useful for the electric vehicle induction coil to be integrated flush with a bottom side of electric vehicle battery unit or the vehicle body so that there are no protrusive parts and so that the specified ground-to-vehicle body clearance may be maintained. This configuration may require some room in the electric vehicle battery unit dedicated to the electric vehicle wireless power subsystem. The electric vehicle battery unit 422 may also include a battery-to-EV cordless interface 422, and a charger-to-battery cordless interface 426 that provides contactless power and communication between the electric vehicle 412 and a base wireless charging system 102*a* as shown in FIG. 1.

In some embodiments, and with reference to FIG. 1, the base system induction coil 104*a* and the electric vehicle induction coil 116 may be in a fixed position and the induction coils are brought within a near-field coupling region by overall placement of the electric vehicle induction coil 116 relative to the base wireless charging system 102*a*. However, in order to perform energy transfer rapidly, efficiently, and safely, the distance between the base system induction coil 104*a* and the electric vehicle induction coil 116 may be reduced to improve coupling. Thus, in some embodiments, the base system induction coil 104*a* and/or the electric vehicle induction coil 116 may be deployable and/or moveable to bring them into better alignment.

FIGS. 5A, 5B, 5C, and 5D are side cross-sectional views of exemplary configurations for the placement of an induction coil and ferrite material relative to a battery, in accordance with exemplary embodiments. Additional variations and enhancements to these configurations are described below.

Figure 5A:
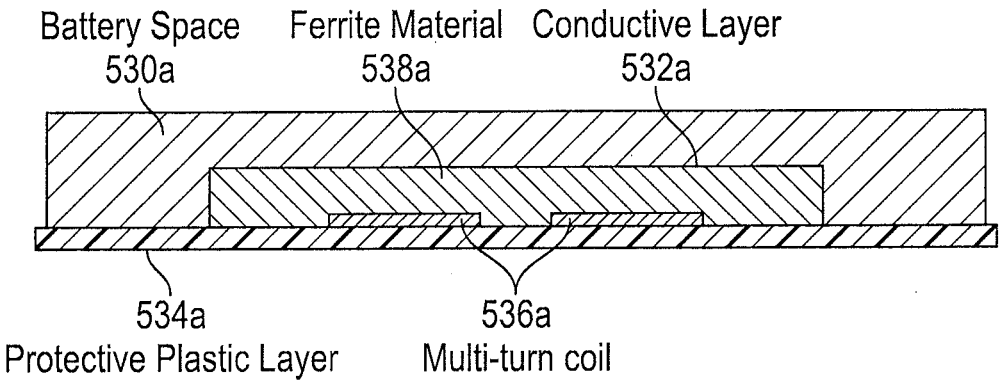
FIGS. 5A, 5B, 5C, and 5D are side cross sectional views of exemplary configurations for the placement of an induction coil and ferrite material relative to a battery, in accordance with exemplary embodiments.

FIG. 5A shows a cross-section view of an example ferrite embedded induction coil 536*a*. The wireless power induction coil may include a ferrite material 538*a* and a coil 536*a* wound about the ferrite material 538*a*. The coil 536*a* itself may be made of stranded Litz wire. A conductive shield 532*a* may be provided to protect passengers of the vehicle from excessive EMF transmission. Conductive shielding may be particularly useful in vehicles made of plastic or composites.

Figure 5B:
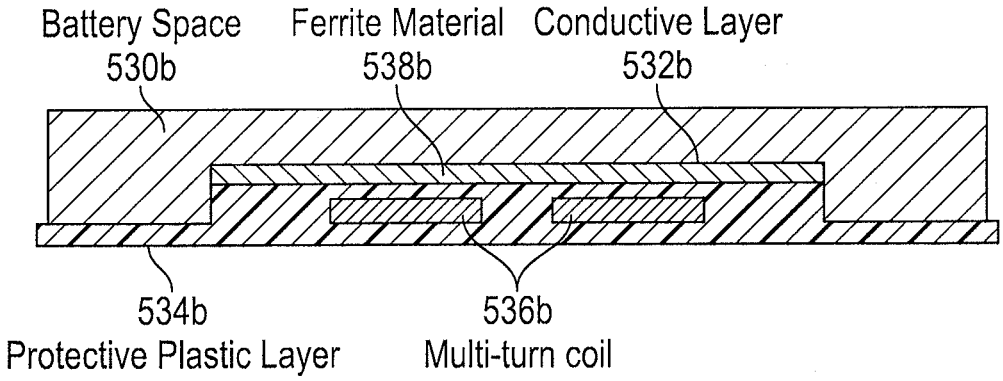

FIG. 5B shows an optimally dimensioned ferrite plate 538*b* (i.e., ferrite backing) to enhance coupling and to reduce eddy currents (heat dissipation) in the conductive shield 532*b*. The coil 536*b* may be fully embedded in a non-conducting non-magnetic (e.g., plastic) material. For example, as illustrated in FIG. 5A-5D, the coil 536*b* may be embedded in a protective housing 534*b*. There may be a separation between the coil 536*b* and the ferrite material 538*b* as the result of a trade-off between magnetic coupling and ferrite hysteresis losses.

Figure 5C:
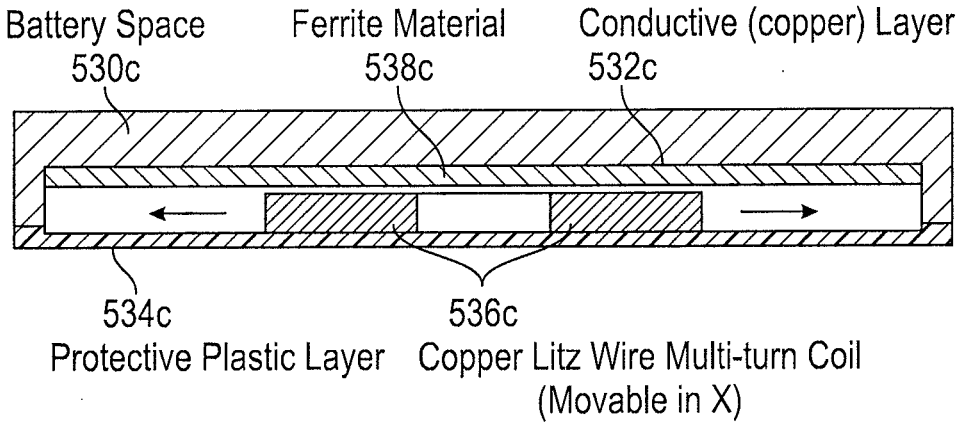

FIG. 5C illustrates another embodiment where the coil 536*c* (e.g., a copper Litz wire multi-turn coil) may be movable in a lateral ("X") direction.

As described herein, coils may comprise Litz wire. Litz wire may be provided for use in high frequency alternating currents. Litz wire may include an insulating sheath including many thin wire strands, each of which are individually insulated and then twisted or woven together. The multiple strands negate the skin effect which can occur at high frequency by having many cores through which the current can travel.

It should be appreciated however that the Litz wire is only one type of conductive filament that can be used in relation to certain embodiments described herein and is given by way of example.

In one embodiment, Litz wire is used which has an external silk or nylon sheath insulation around the bundle of strands.

Two layers of nylon may be used which assists the epoxy to wick into the Litz wire. The braid used may be sufficiently fine so as not to reduce the flexibility of the wire and not add too much thickness to the cable.

The purpose of the sheath initially is to provide insulation to the strands enabling them to cooperate as a single conductive wire.

Litz wire has strands that may be fragile and prone to breakage, particularly when used in an impact exposed situation.

The individual strands can be coated with an insulating layer such as enamel or polyurethane.

Figure 5D:
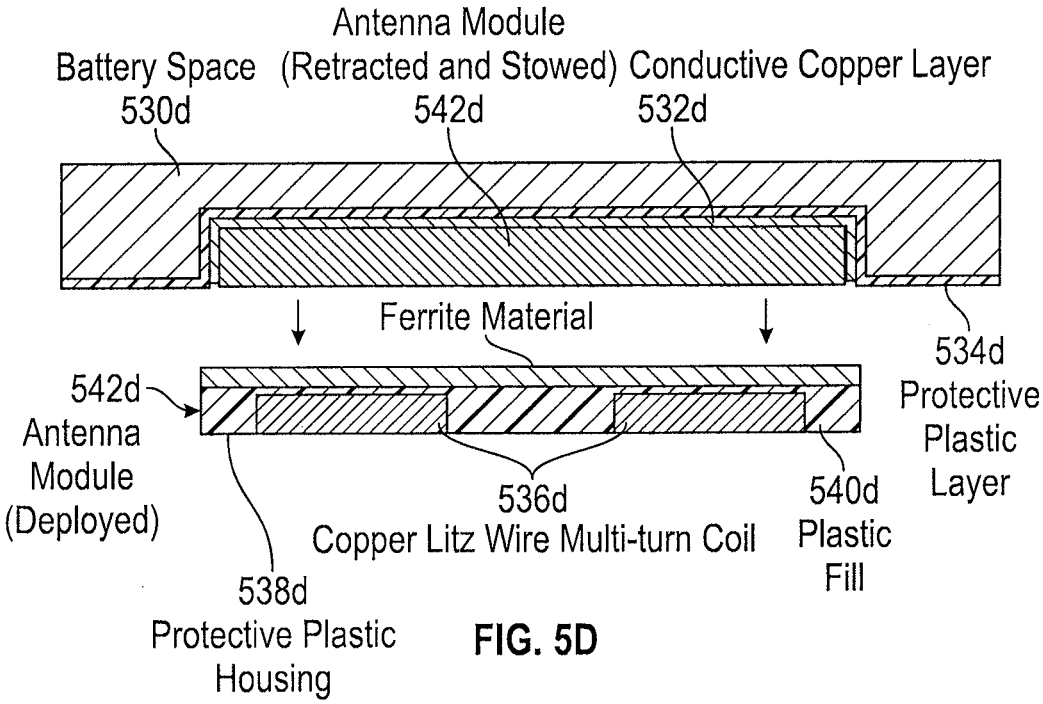

FIG. 5D illustrates another embodiment where the induction coil module is deployed in a downward direction. In some embodiments, the battery unit includes one of a deployable and non-deployable electric vehicle induction coil module 540*d* as part of the wireless power interface. To prevent magnetic fields from penetrating into the battery space 530*d* and into the interior of the vehicle, there may be a conductive shield 532*d* (e.g., a copper sheet) between the battery space 530*d* and the vehicle. Furthermore, a non-conductive (e.g., plastic) protective layer 533*d* may be used to protect the conductive shield 532*d*, the coil 536*d*, and the ferrite material 538*d* from environmental impacts (e.g., mechanical damage, oxidization, etc.). Furthermore, the coil 536*d* may be movable in lateral X and/or Y directions. FIG. 5D illustrates an embodiment wherein the electric vehicle induction coil module 536*d* is deployed in a downward Z direction relative to a battery unit body.

The design of this deployable electric vehicle induction coil module 542*b* is similar to that of FIG. 5B except there is no conductive shielding at the electric vehicle induction coil module 542*d*. The conductive shield 532*d* stays with the battery unit body. The protective layer 534*d* (e.g., plastic layer) is provided between the conductive shield 532*d* and the electric vehicle induction coil module 542*d* when the electric vehicle induction coil module 542*d* is not in a deployed state. The physical separation of the electric vehicle induction coil module 542 from the battery unit body may have a positive effect on the performance of the induction coil.

As discussed above, the electric vehicle induction coil module 542*d* that is deployed may contain only the coil 536*d* (e.g., Litz wire) and ferrite material 538*d*. Ferrite backing may be provided to enhance coupling and to prevent from excessive eddy current losses in a vehicle's underbody or in the conductive shield 532*d*. Moreover, the electric vehicle induction coil module 542*d* may include a flexible wire connection to power conversion electronics and sensor electronics. This wire bundle may be integrated into the mechanical gear for deploying the electric vehicle induction coil module 542*d*.

With reference to FIG. 1, the charging systems described above may be used in a variety of locations for charging an electric vehicle 112, or transferring power back to a power grid. For example, the transfer of power may occur in a parking lot environment. It is noted that a "parking area" may also be referred to herein as a "parking space." To enhance the efficiency of a vehicle wireless power transfer system 100, an electric vehicle 112 may be aligned along an X direction and a Y direction to enable an electric vehicle induction coil 116 within the electric vehicle 112 to be adequately aligned with a base wireless charging system 102*a* within an associated parking area.

Furthermore, the disclosed embodiments are applicable to parking lots having one or more parking spaces or parking areas, wherein at least one parking space within a parking lot may comprise a base wireless charging system 102*a*. Guidance systems (not shown) may be used to assist a vehicle operator in positioning an electric vehicle 112 in a parking area to align an electric vehicle induction coil 116 within the electric vehicle 112 with a base wireless charging system 102*a*. Guidance systems may include electronic based approaches (e.g., radio positioning, direction finding principles, and/or optical, quasi-optical and/or ultrasonic sensing methods) or mechanical-based approaches (e.g., vehicle wheel guides, tracks or stops), or any combination thereof, for assisting an electric vehicle operator in positioning an electric vehicle 112 to enable an induction coil 116 within the electric vehicle 112 to be adequately aligned with a charging induction coil within a charging base (e.g., base wireless charging system 102*a*).

As discussed above, the electric vehicle charging system 114 may be placed on the underside of the electric vehicle 112 for transmitting and receiving power from a base wireless charging system 102*a*. For example, an electric vehicle induction coil 116 may be integrated into the vehicles underbody, e.g., near a center position providing maximum safety distance in regards to EM exposure and permitting forward and reverse parking of the electric vehicle.

Certain embodiments described herein are directed towards ways by which wireless power transfer pads can be constructed to withstand impact and compressive forces, while still maintaining their electrical integrity.

Figure 6A:
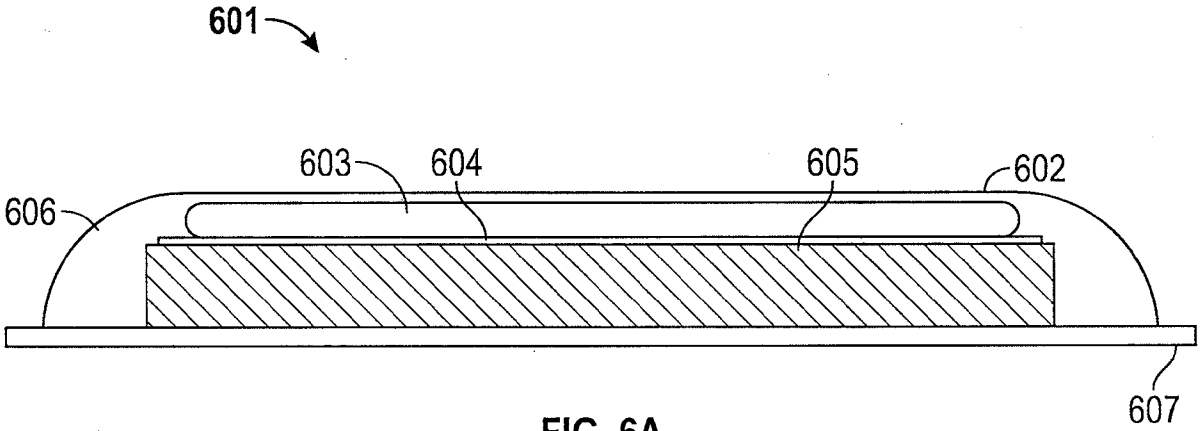
FIG. 6A is a side cross-sectional view of an exemplary wireless power transfer pad, in accordance with an exemplary embodiment.
Figure 6B:
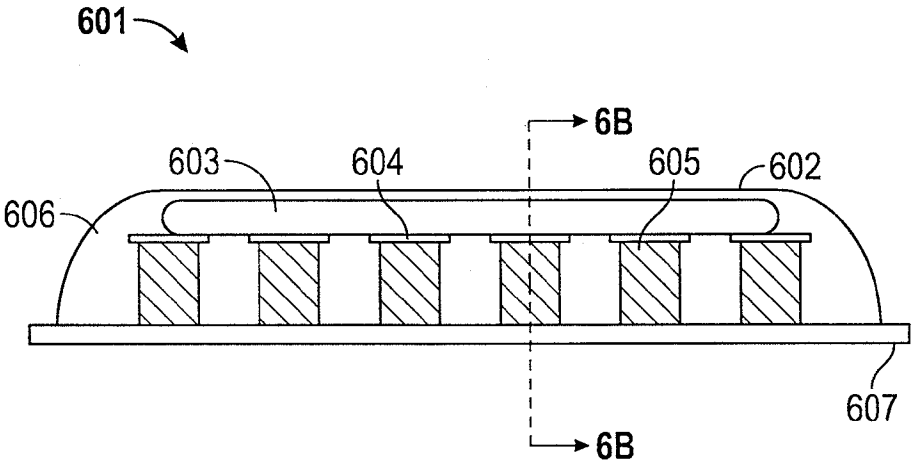
FIG. 6B is a side cross-sectional view of the exemplary wireless power transfer pad of FIG. 6A, taken along lines 6B-6B.

FIG. 6A is a side cross-sectional view of an exemplary wireless power transfer pad 601, in accordance with an exemplary embodiment. FIG. 6B is a side cross-sectional view of the exemplary wireless power transfer pad of FIG. 6A, taken along lines 6B-6B. It should be appreciated that the principles described herein can be used in relation to transmitter and receiver pads in accordance with embodiments described herein.

For example, in certain embodiments, the transmitter, ground or base pad 601 is constructed to be IP67 rated (Ingress Protection Rating that is rated for no ingress of dust and complete protection against contact and also rated to be waterproof) so it can be used when raining or in snow without concerns about electrical shock or reduced system operation. In certain embodiments, the ground or base pad 601 is constructed to be further generally robust to withstand impacts of a car driving over the ground or base pad.

The receiver, vehicle and mobile pad can also be constructed to be IP67 rated so that it is unaffected by the high pressure water that it will be in contact with during driving in the rain. As noted above, the pad is constructed to be generally durable to resist rocks and scratches that the pad may experience when a vehicle is driving.

In one embodiment, the wireless power transfer pad 601 has an exterior casing or shell 602. The casing or shell 602 can be made from any suitable durable material. For example, the material can be made from plastic material such as polyethylene or other impact resistant materials.

Other materials can include fiberglass, plastics, ceramics and non-conductive composites.

The pad 601 includes a coil of Litz wire 603 that is placed or wound around the casing or shell 602. Other conductive filaments may also be used for the casing. The pad 601 further includes ferrite blocks 605. The pad 601 further includes a layer of insulating material 604 between the ferrite blocks 605 and the coil of Litz wire 603. As will be further described below epoxy 606 may be included to seal and tighten all the components in a way to achieve the IP67 rating as described above.

Figure 7:
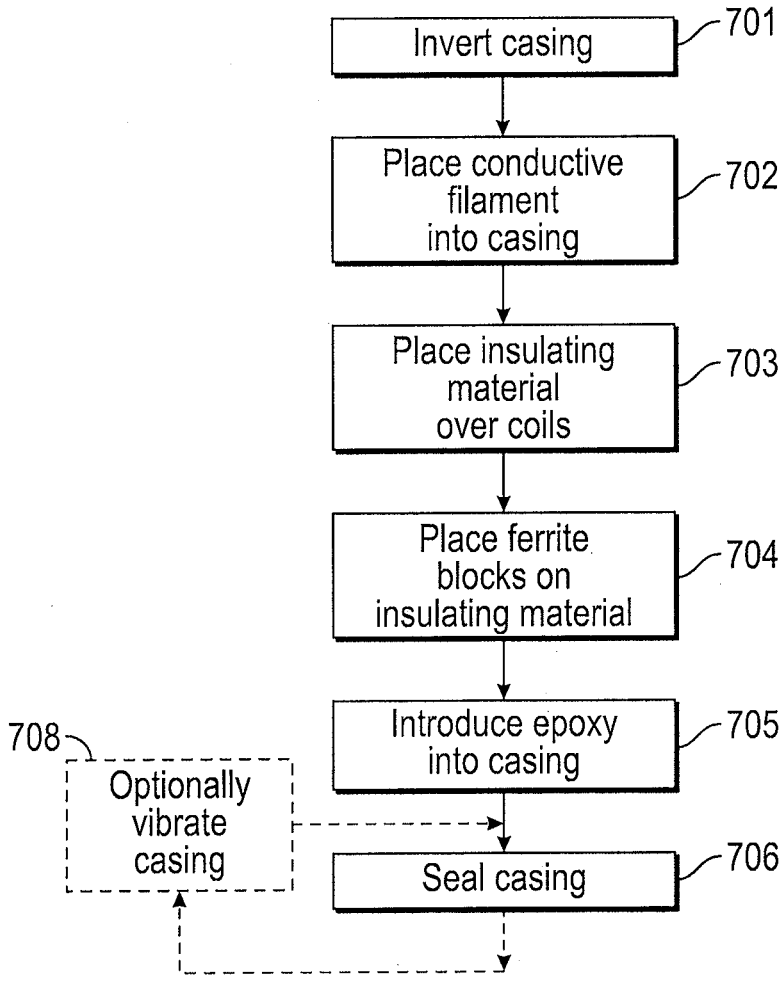
FIG. 7 is a flow chart illustrating an exemplary method of construction a wireless power transfer pad, in accordance with an exemplary embodiment.

FIG. 7 is a flow chart depicting an example method of constructing the wireless power transfer pad 601 of FIG. 6 in accordance with one embodiment.

At block 701, the casing 602 is inverted prior to the electrical components being placed therein.

At block 702, a coil of Litz wire 603 is placed or wound onto the casing 602. It should be appreciated that other conductive filaments can be used other than Litz wire according to other embodiments.

At block 703 a layer of insulating material 604 is placed over the coil 603.

After the layer of insulating material 604 is put into position, a number of ferrite blocks 605 can be placed into the casing at block 704.

At block 705, a settable fluid 606 is introduced into the casing. In one embodiment, the settable fluid is an epoxy resin such as marine grade epoxy with a viscosity of approximately 725 cPs.

Reference throughout this specification shall now be made to the fluid as being epoxy although this should not be seen as limiting.

The epoxy 606 can have a viscosity when poured such that it readily permeates about and around the electrical components placed into the casing 602 such that the electrical components are completely impregnated by the epoxy 606. This can ensure that the electrical components become fully integrated with the pad 601, thus, as a consequence, allowing impact forces to be more evenly distributed throughout the pad 601.

The aluminum plate 607 can be placed to seal the casing 602 and complete the pad 601 construction as in block 706.

In certain embodiments, the epoxy 606 is introduced to the pad so that the coil of Litz wire 603 is impregnated with the epoxy 606 filling in the spaces around the individual strands making up the Litz wire. This is better illustrated in FIG. 8 as will be described below.

It should be appreciated that special care is required when choosing the appropriate Litz wire 603 to be used. Litz wire can be coated in a variety of sheaths, some nylon, some plastic, silk and paper. In some embodiments, there may be advantages to use a loosely woven nylon sheath (e.g., as produced by Sofilec™) having two layers of nylon enables the epoxy to saturate the insulation fibers around the wires or filaments that they include.

As will be further described below, optionally at block 707, vibrations may be applied to the pad 601, particularly high frequency vibrations, causing the epoxy to move into a sheath of the Litz wire as well as around all of the other electronic components within the case 602.

Figure 8:
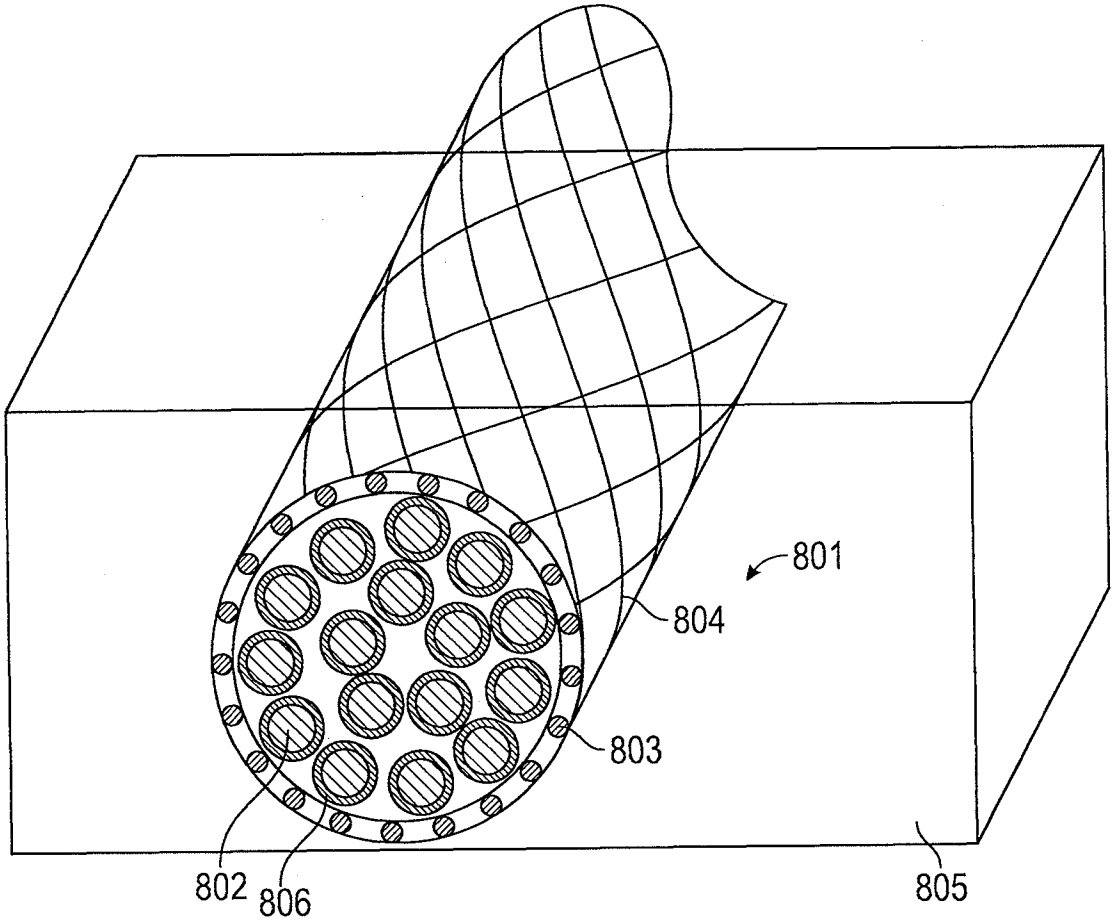
FIG. 8 is a perspective view of a cross-section of impregnated Litz wire, in accordance with an exemplary embodiment.

FIG. 8 is a perspective view of a cross-section of a Litz wire 801 that may be used in the wireless power transfer pad 601 of FIG. 6, in accordance with an exemplary embodiment. The Litz wire 801 includes a number of wires bundled together in an insulating sheath 803. Each wire has a central conductive copper core 802 and a surrounding insulating coating 806. A nylon sheath 803 is made up of a number of woven strands 804. The weave of the strands 804 are sufficiently loose that epoxy 805 can penetrate the apertures between the strands acting to lock the Litz wire 801 into an epoxy matrix in the casing and the cores 802 relative to each other.

The penetration of the epoxy into the Litz wire coating may occur as a result of introducing the epoxy into the casing 602 (FIG. 6). However, in some embodiments the epoxy 805 and or Litz wire 801 may be moved or worked in such a way to encourage penetration of the epoxy 805 and removal of any air bubbles trapped around the wires. For example, in production assembly, vibrations may be applied to the pad 601, particularly high frequency vibrations, causing the epoxy to move into the sheath 804 as well as around all of the other electronic components within the case 602 (optional block 707 in FIG. 7).

It should be appreciated that the locking in of a conductive filament such as the Litz wire 801 into a settable fluid such as the epoxy 805 can provide a structural matrix which is highly impact resistant. For example, an analogous substance is fiberglass which is a combination of glass fibers in an epoxy resin. However, certain embodiments described herein have more significant advantages as it uses as a structural fiber, a conductive fiber already used within the pad 601 construction. This is a highly economical use of existing components.

Furthermore, the epoxy 805 also protects the fragile filaments 801 from breaking by securely holding them in the matrix in the case 602.

Further the matrix creates additional voltage isolation, stops the strands from rubbing against each other due to vibrations in the pad (such as those caused by the repeated compression and decompression of magnetic domains in the ferrite) as well as creating a lattice of bonded wires adding significantly to the mechanical strength of the pad 601.

It should be noted that after the epoxy 606 (FIG. 6) is introduced into the casing 602, an aluminum pad 607 is fitted to the casing 602 providing a completely sealed unit 601. The aluminum sheet 607 also adds an electromagnetic shield as well as an increased mechanical strength.

Breakage of the conductive filaments used is potentially a serious problem. In particular, there are a number of locations within a pad construction which can be the source of potential abrasion arising from external vibration applied during normal use or through just normal assembly.

Figure 9:
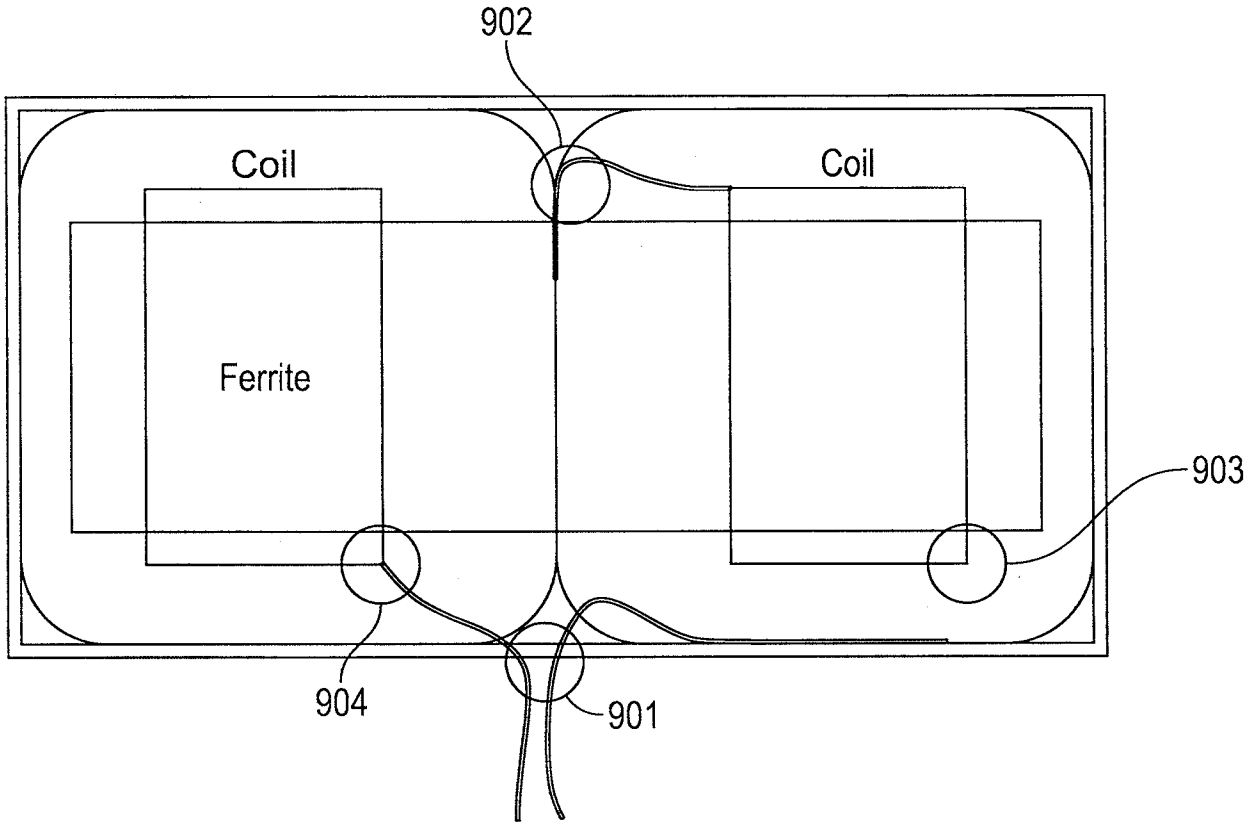
FIG. 9 is a top plan view of a wireless power transfer pad showing potential abrasion sites, in accordance with an exemplary embodiment.

FIG. 9 is a top plan view of potential abrasion sites in accordance with an exemplary embodiment.

In some embodiments there may be provided a way of reducing the potential abrasive forces on the conductive filaments by applying an abrasion resistant layer to selected areas on the conductive filaments such that when the conductive filaments are in position in the casing, the filaments are shielded by the abrasion resistant layer at the potential sites for abrasion.

In certain embodiments, the abrasion resistant layer is heat-shrink, but this can be other material such as tape or Mylar® registered trademark of the Dupont company.

These potential abrasion sites can include exit/entry points 901, coil overlaps 902 and corners 903 and contact with ferrite 904.

It should be appreciated that methods employed to protect the Litz wire described herein can also hinder efforts to reposition the Litz wire, particularly if correction in cable layout is desired.

Therefore in one embodiment there is provided a technique of shaping the Litz wire which has either been impregnated with epoxy or covered in heat shrink by reheating either the epoxy or heat shrink after they have been applied. The method of heating can incorporate a number of mechanisms including direct radiant heat. In certain embodiments, the method of heating involves using hot air.

Figure 10:
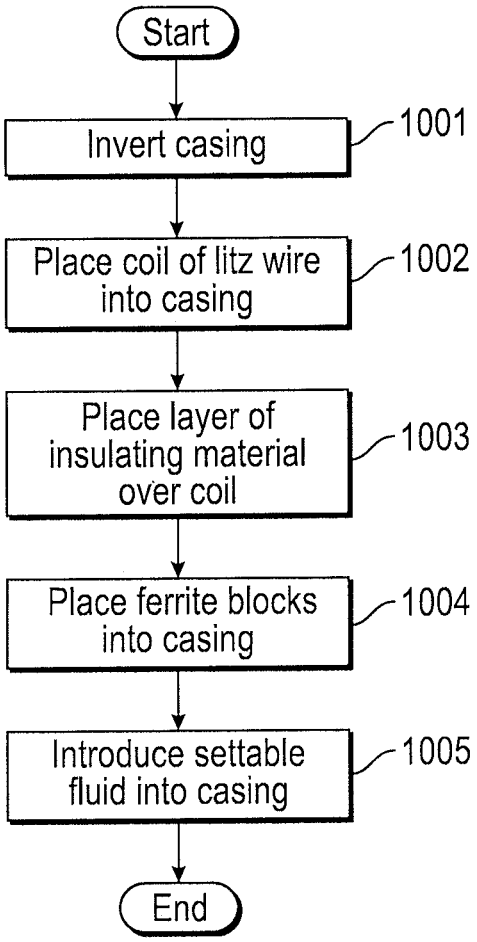
FIG. 10 is a flow chart illustrating another exemplary method of construction of a wireless power transfer pad.

FIG. 10 illustrates another method 1000 of constructing the wireless power transfer pad 601, with reference to FIG. 6, in accordance with an exemplary embodiment. In certain embodiments, as described above with reference to FIG. 7, at block 1001 of method 1000, casing 602 is inverted prior to the electrical components being placed therein.

Next, at block 1002 a coil of Litz wire 603 is placed or wound onto the casing 602. It should be appreciated that other conductive filaments can be used. Then at block 1003, a layer of insulating material 604 is placed over the coils.

In accordance with embodiments described with reference to FIG. 10, the choice of insulating material may provide various advantages.

In order to prevent fires occurring, the insulating layer 604 may be selected to provide sufficient voltage isolation between the coils and the ferrite blocks which are then placed into the casing.

In one embodiment, the maximum voltage isolation required is in the order of 2.5 kV or 850 Vrms. However, there may be parts of the pad where far less isolation is required or the pad could be designed to keep the high voltages physically apart to avoid the need for so much isolation.

Therefore, in accordance with certain embodiments, an insulating layer is chosen such that the dielectric strength and the thickness of the insulating layer provides this voltage isolation.

In one embodiment, the BoPET (biaxially-oriented polyethylene terephthalate), commonly marketed under the trade mark Mylar® (registered trademark of the Dupont company), is used as an insulating layer.

In one embodiment, the thickness of the Mylar® is selected carefully to provide various advantages and several variables may be taken into consideration when determining the thickness. For example, the di-electric strength of Mylar® is non-linear for thickness therefore making it difficult to calculate the actual thickness required. Further, the properties of Mylar® film are given with DC voltage ratings, yet, the requirement as described herein relates to insulating against AC voltages instead. Mylar® has a very high corona resistance making it ideal for high voltage AC applications.

In one embodiment, Mylar® sheets used have a thickness in the order of or greater than 0.125 mm giving a voltage isolation in the order of 850 Vrms providing the appropriate electrical insulation without compromising flexibility.

It should be appreciated however that other materials may be used (for example polyamide tape) often marketed under the trade mark Kapton® (registered trademark of the Dupont company). If the Kapton® tape is used, then to provide the appropriate voltage isolation, a thickness in the order of 0.25 mm is sufficient given approximately 8 kV isolation.

However, it is important that in addition to providing the electrical insulation required, the layer is also mechanically insulating given the environment to which the pad 601 is exposed.

Thus, the material chosen for the layer provides impact resistance, and preferably sufficient tensile strength which can contribute to the overall strength of the pad 601.

Mylar® also has high tensile strength with a Young's modulus of about 3 to 4 GPa and a tensile strength of 55 to 75 MPa.

In other embodiments, other materials used (such as Kapton® tape or silk) may have similar strength properties.

In some embodiments, there may be a maximum thickness of material used in order to provide sufficient flexibility of the layer within the casing. For example, in some embodiments it may be desired to wrap the layer around the sharp edges of the ferrite (or other components such as coils) as appropriate. To achieve this flexibility, there may be a compromise between obtaining the required mechanical insulation, strength and electrical insulation.

It should be appreciated that in some embodiments, the layer may also be placed between other components such as the coils. As will be described further below with reference to FIG. 11, the insulating layer with such a thickness may be configured within the pad in a particular way in accordance with some embodiments. In some embodiments, the insulating layer is shaped to accommodate the construction of the casing.

After the layer of insulating material 604 is put into position at block 1003, a number of ferrite blocks 605 can then be placed into the casing at block 1004.

In some embodiments, a settable fluid 606 may be introduced into the casing at block 1005 as described above. In one embodiment, the settable fluid is an epoxy resin such as marine grade epoxy with a viscosity of approximately 725 cPs. As further described above, the epoxy 606 can have a viscosity when poured such that it can readily permeate throughout the electrical components placed into the casing 602. This can ensure that the electrical components becomes fully integrated with the pad 601, as a consequence allowing impact forces to be more evenly distributed throughout the pad 601. Therefore, the insulating layer may have apertures therein to allow appropriate epoxy flow throughout the casing.

Figure 11:
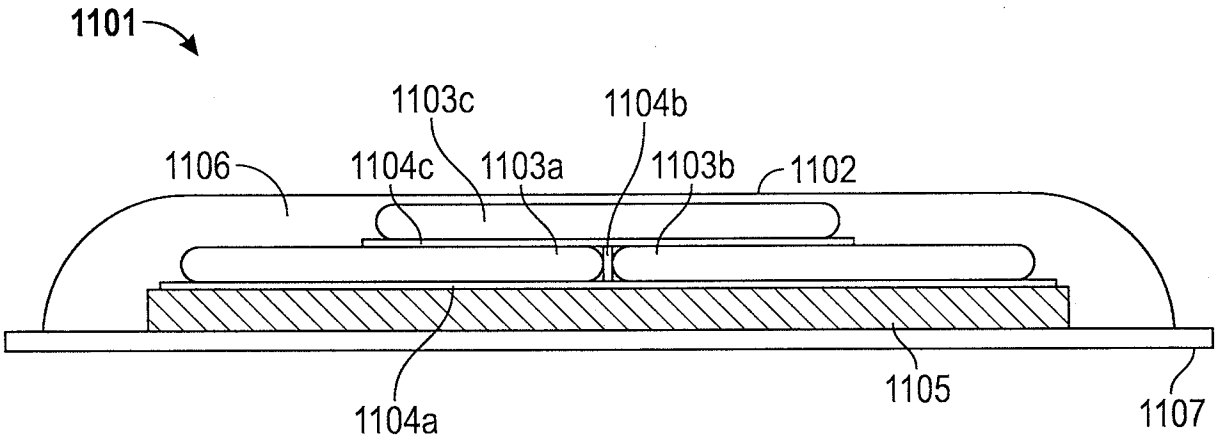
FIG. 11 is a side cross-sectional view of another exemplary wireless power transfer pad, in accordance with an embodiment.

FIG. 11 is a side cross-sectional view of another exemplary wireless power transfer pad 1101, in accordance with an embodiment. For example, FIG. 11 illustrates a pad 1101 similar to the pad shown in FIG. 6, according to another embodiment with a different configuration for the insulating layer configured according to the embodiment described with reference to FIG. 10.

In this embodiment, the pad 1101 has an external casing 1102, an aluminum back plate 1107, a number of coils 1103*a*, 1103*b*, and 1103*c*, and ferrite blocks 1105, as all described above with reference to FIG. 6.

Epoxy 1106 fills in the gaps between the components held within the casing 1102 as described above with reference to FIGS. 7-10.

In this embodiment, three stacked coils are shown positioned between the exterior casing 1102 and the ferrite block 1105.

The embodiment shown in FIG. 11 further includes a Mylar® layer 1104*a* fitted between the lower coils 1103*a*, 1103*b* and the ferrite block 1105.

Due to the configuration having additional coils, there are additional layers of Mylar® used, namely a partitioning layer 1104*b* between the horizontally aligned coils 1103*a* and 1103*b*. Further, there is another layer of Mylar® 1104*c* between the top coil 1103*c* and the lower coils 1103*a* and 1103*b*. Materials with similar properties as Mylar® may be used in place of the Mylar®.

Each of the Mylar® layers 1104*a*, 1104*b*, and 1104*c* have substantially identical thickness and provide similar electrical and physical isolation between the coils and the ferrite blocks.

Construction of the pad 1101 can include the use of support pillars (not shown) which provide additional strength to the pad as well as assisting in the positioning of other components within the casing. Thus, the layer may also include apertures to accommodate the pillars as well. Further, the interlocking of the insulating layer with the pillars may also add to the strength of the pad.

Figure 12:
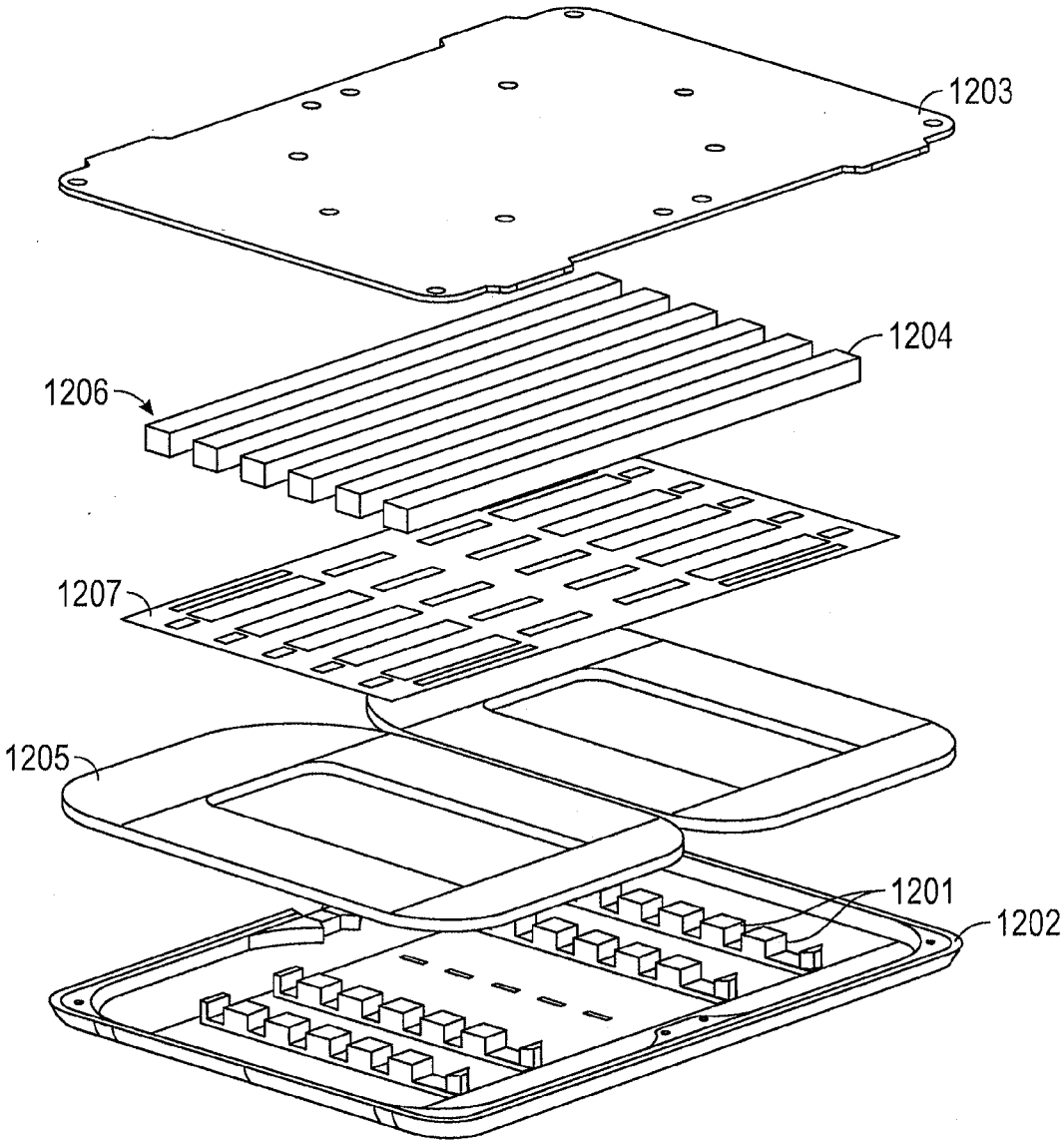
FIG. 12 is an exploded isometric view of an exemplary wireless power transfer apparatus, in accordance with an embodiment.

FIG. 12 is an exploded isometric view of an exemplary wireless power transfer apparatus, in accordance with an embodiment. FIG. 12 shows the pad with pillars 1201 extending from a first casing portion 1202 to abut against a second casing portion 1203.

Just beneath the second casing portion 1203 are ferrite blocks 1204. And above the pillars 1201 are induction coils 1205.

In the middle of the assembly 1206 is an insulating layer 1207, e.g., Mylar® as described above. The insulator layer 1207 comprises a plurality of holes positioned to allow the pillars 1201 to pass through the holes when the insulating layer 1207 is placed on top of the coils 1205. The insulating layer 1207 is therefore held in position by the pillars 1201.

The holes within the insulating layer 1207 also allow the passage of epoxy resin into the pad (as described previously) further helping to hold the various layers and components in place.

As such, in accordance with the device described with reference to FIGS. 6-12, one aspect of the disclosure provides a device comprising a casing including electrical components. It should be appreciated that the term "electrical components" can mean any parts or integers used in an electromagnetic device including but not limited to wires, coils, transformers, ferrite cores, switches and the like. The device may be a pad configured to transfer or receive power wirelessly. The electrical components can comprise a magnetic core and an inductive coil. The device can comprise one or more magnetically permeable members, an inductive coil magnetically associated with the magnetically permeable members, and at least one layer of an insulating material to electrically and mechanically insulate the electric coil from the one or more magnetically permeable members. The insulating layer may be placed between at least two coils. The insulating layer may comprise biaxially-oriented polyethylene terephthalate. The thickness of the insulating layer may be between 0.1 mm and 1.5 mm. The insulating layer may be in the form of polyamide tape. The layer may provide a minimum voltage isolation in the order of at least 2.5 kV or 850 Vrms. The insulating layer may have a tensile strength in the order of at least 55 MPa. The layer may have apertures to accommodate fluid flow throughout the casing.

According to a related aspect, one aspect of the present disclosure provides a method for constructing a casing including electrical components in a device comprising one or more magnetically permeable members, and an electric coil magnetically associated with the magnetically permeable members. The method can comprise placing at least one layer of an insulating material between the electric coil and the one or more magnetically permeable members for electrical and mechanical isolation. The device may be a pad configured to transfer or receive power wirelessly.

The various operations of methods described above may be performed by any suitable means capable of performing the operations, such as various hardware and/or software component(s), circuits, and/or module(s). Generally, any operations illustrated in the Figures may be performed by corresponding functional means capable of performing the operations. For example, with reference to FIG. 6, means for encasing electrical components may comprise a casing 602. Means for conducting electricity may comprise conductive filaments of a coil 603. Means for wrapping may comprise a sheath.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. The described functionality may be implemented in varying ways for each particular application, but such implementation decisions should not be interpreted as causing a departure from the scope of the embodiments described herein.

The various illustrative blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm and functions described in connection with the embodiments disclosed herein may be embodied directly in hardware, in a software module executed by a processor, or in a combination of the two. If implemented in software, the functions may be stored on or transmitted over as one or more instructions or code on a tangible, non-transitory computer-readable medium. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD ROM, or any other form of storage medium known in the art. A storage medium is coupled to the processor such that the processor can read information from, and write information to, the storage medium. In the alternative, the storage medium may be integral to the processor. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer readable media. The processor and the storage medium may reside in an ASIC. The ASIC may reside in a user terminal. In the alternative, the processor and the storage medium may reside as discrete components in a user terminal.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

Various modifications of the above described embodiments will be readily apparent, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A wireless power transfer apparatus, comprising:
a casing;
an electrical component housed within the casing;
a sheath housed within the casing;
a plurality of conductive filaments housed within the sheath, each conductive filament comprising its own insulating coating, the electrical component being electrically coupled to the plurality of conductive filaments; and
a set insulating fluid that:
fills the casing,
penetrates the sheath, and
forms a structural matrix with the plurality of conductive filaments within the sheath.

2. The apparatus of claim 1, wherein the electrical component and the plurality of conductive filaments form a circuit configured to transfer or receive power wirelessly.

3. The apparatus of claim 1, wherein the plurality of conductive filaments form Litz wire.

4. The apparatus of claim 1, wherein the set insulating fluid comprises epoxy resin.

5. The apparatus of claim 1, further comprising an insulating layer housed within the casing and one or more ferromagnetic magnetically permeable members housed within the casing, the insulating layer configured to physically separate and electrically insulate the plurality of conductive filaments from the one or more ferromagnetic magnetically permeable members.

6. The apparatus of claim 5, wherein the insulating layer comprises biaxially oriented polyethylene terephthalate.

7. The apparatus of claim 6, wherein the thickness of the insulating layer is between 0.1 millimeters and 1.5 millimeters.

8. The apparatus of claim 5, wherein the insulating layer comprises apertures configured to accommodate fluid flow of the set insulating fluid throughout the casing.

9. The apparatus of claim 1, further comprising an abrasion material layer configured to shield at least a portion of an area of the plurality of conductive filaments.

10. The apparatus of claim 9, wherein the portion of the area corresponds to locations subject to abrasion comprising at least one of entry points, exit points, overlaps or corners.

11. The apparatus of claim 9, wherein the abrasion material layer comprises a heat shrink.

12. A wireless power transfer apparatus, comprising:
means for encasing electrical components;
an electrical component housed within the encasing means;
a plurality of means for conducting electricity;
means for isolating each means for conducting of the plurality of means for conducting; and
means for wrapping the plurality of means for conducting and each respective means for isolating, the electrical component electrically coupled to the plurality of means for conducting, the means for encasing filled with a set insulating fluid configured to:
penetrate the means for wrapping, and
form a structural matrix with the plurality of means for conducting and means for isolating.

13. The apparatus of claim 12, wherein the electrical component and the plurality of means for conducting are configured to form a circuit configured to wirelessly transfer or receive power.

14. The apparatus of claim 12, further comprising means for insulating one or more ferromagnetic, magnetically permeable members from the means for conducting.

15. The apparatus of claim 14, wherein the means for insulating comprises biaxially oriented polyethylene terephthalate.

16. The apparatus of claim 14, wherein the means for insulating comprises apertures configured to accommodate fluid flow of the set insulating fluid throughout the means for encasing.

17. The apparatus of claim 12, wherein the plurality of means for conducting comprises Litz wire, and wherein the means for wrapping comprises a sheath.

18. The apparatus of claim 12, further comprising means for shielding at least a portion of an area of the plurality of means for conducting electricity.

19. The apparatus of claim 18, wherein the portion of the area corresponds to locations subject to abrasion comprising at least one of entry points, exit points, overlaps or corners.

20. The apparatus of claim 18, wherein the means for shielding comprises a heat shrink.

21. A method for wirelessly transferring power with a wireless power transfer device, the method comprising:
coupling a wireless power transfer device to a magnetic field via an induction circuit comprising an electrical component and a plurality of conductive filaments housed within a sheath, each conductive filament comprising its own insulating coating, the electrical component, the plurality of conductive filaments, the insulating coatings, and the sheath all housed within a casing filled with a set insulating fluid that penetrates the sheath and forms a structural matrix with the insulating coating of each conductive filament within the sheath; and
transferring power via the magnetic field.

22. The method of claim 21, wherein the plurality of conductive filaments comprise Litz wire.

23. The method of claim 21, wherein the set insulating fluid comprises epoxy resin.

24. The method of claim 21, wherein the casing further houses an insulating layer casing and one or more ferromagnetic magnetically permeable members, the insulating layer configured to electrically insulate the plurality of conductive filaments from the one or more ferromagnetic magnetically permeable members.

25. The method of claim 24, wherein the insulating layer comprises biaxially oriented polyethylene terephthalate.

26. The method of claim 25, wherein the thickness of the insulating layer is between 0.1 millimeters and 1.5 millimeters.

27. The method of claim 24, wherein the insulating layer comprises apertures configured to accommodate fluid flow of the set insulating fluid throughout the casing.

28. The method of claim 21, wherein the casing further houses at least an abrasion material layer configured to shield a portion of an area of the conductive filaments.

29. The method of claim 28, wherein the portion of the area corresponds to locations subject to abrasion comprising at least one of entry points, exit points, overlaps or corners.

30. The method of claim 28, wherein the abrasion material layer comprises a heat shrink.

* * * * *